US005857219A

United States Patent [19]

Edmark

[11] Patent Number: 5,857,219

[45] **Date of Patent: *Jan. 12, 1999**

[54] COLLAPSIBLE HAT FOR MAINTAINING A WEARERS HAIRSTYLE WITH STRUCTURE TO REDUCE WRINKLING

[76] Inventor: Tomima L. Edmark, P.O. Box 671269, Dallas, Tex. 75367

[ * ] Notice: The term of this patent shall not extend beyond the expiration date of Pat. No. 5,657,490.

[21] Appl. No.: 832,760

[22] Filed: Apr. 4, 1997

Related U.S. Application Data

[63] Continuation-in-part of Ser. No. 511,637, Aug. 7, 1995, Pat. No. 5,657,490.

[51] Int. Cl.[6] ..... A42C 5/00

[52] U.S. Cl. ..... 2/182.2; 2/175.2; 2/175.4; 2/175.5; 2/182.6; 2/918

[58] Field of Search ..... 2/175.2, 175.4, 2/175.5, 181, 182.1, 182.2, 182.6, DIG. 1, 918

[56] References Cited

U.S. PATENT DOCUMENTS

| | | | |
|---|---|---|---|
| D. 352,596 | 11/1994 | Williams, Jr. | D2/887 |
| 2,088,930 | 8/1937 | Schwarz | 2/175.4 |
| 2,716,753 | 9/1955 | Gordon | 2/195 |
| 2,803,015 | 8/1957 | Milone | 2/177 |
| 3,097,363 | 7/1963 | LeBlanc | 2/177 |
| 3,505,683 | 4/1970 | Wright | 2/198 |
| 3,737,081 | 6/1973 | James | 223/84 |
| 3,739,401 | 6/1973 | Fekete | 2/175 |
| 3,852,822 | 12/1974 | Watkins et al. | 2/3 B |
| 3,869,727 | 3/1975 | Hartman et al. | 2/175 |
| 4,096,590 | 6/1978 | Keshock | 2/180 |
| 4,443,892 | 4/1984 | Burgin | 2/418 |
| 4,549,316 | 10/1985 | Johnson | 2/195 |
| 4,682,373 | 7/1987 | Baran | 2/175 |
| 4,815,784 | 3/1989 | Zheng | 296/97.7 |
| 4,982,449 | 1/1991 | Finkelstein | 2/192 |
| 4,999,851 | 3/1991 | Hall | 2/180 |
| 5,188,097 | 2/1993 | Hansen | 128/36 |
| 5,247,709 | 9/1993 | Epply | 2/175.1 |
| 5,287,561 | 2/1994 | Spector | 2/209.11 |
| 5,365,612 | 11/1994 | Yoshida | 2/171 |
| 5,493,735 | 2/1996 | Rice | 2/209 |
| 5,657,490 | 8/1997 | Edmark | 2/182.6 |

FOREIGN PATENT DOCUMENTS

| | | | |
|---|---|---|---|
| 94/09658 | 5/1994 | WIPO | 2/181 |

*Primary Examiner*—Diana L. Biefeld
*Attorney, Agent, or Firm*—J. M.(Mark) Gilbreth; Robert W. Strozier; Gilbreth & Strozier, P.C.

[57] ABSTRACT

A hat having elongated support members extending from the exterior of the crown of the hat, for supporting the hat upon the head of the wearer, to prevent the hat from causing any undue adverse affect to the wearer's hair style. An alternative embodiment of the hat further includes a casing having a framing that is either attached to the crown or a brim, which framing may be twisted to collapse the hat into a small compact size and shape. Another alternative embodiment of the hat further includes a layer of material for reducing the ability of the crown of the hat to become wrinkled after the hat is un-collapsed.

18 Claims, 8 Drawing Sheets

COLLAPSIBLE HAT FOR MAINTAINING A WEARERS HAIRSTYLE WITH STRUCTURE TO REDUCE WRINKLING

RELATED APPLICATION DATA

This application is a Continuation-In-Part application of U.S. patent application Ser. No. 08/511,637 filed Aug. 7, 1995 now issued as U.S. Pat. No. 5,657,490.

BACKGROUND OF THE INVENTION

1. Field of the Invention

The present invention relates to hats. In even another aspect, the present invention relates to hats that can be worn without having an undue adverse affect on the wearer's hair style. In still another aspect the present invention relates to collapsible hats. In yet another aspect, the present invention relates to collapsible hats which can be worn without having an undue adverse affect on the wearer's hair style. In even still another aspect, the present invention relates to hats that do not utilize a headband circumferentially contacting the head, but rather which utilize a multiplicity of elongated support members to support the hat on the head, thus minimizing any undue adverse affect on the wearer's hairstyle, and/or allowing air to circulate around the wearer's hair. In even yet another aspect, the present invention relates to collapsible hats which contain a structure that maintains the shape of the hat, and reduces wrinkling of the crown.

2. Description of the Related Art

Hats are many times used to accessorize an outfit. Unfortunately, one of the problems encountered with wearing a hat is that the wearer's hair style will tend to be affected in an undesirable manner by the hat. For example, a headband indentation may be formed into the wearers's hair, the hair may be "flattened" by the hat, or the hair may be rearranged by the hat.

Additionally, hats that have wide brims suitable for shielding the wearer from the sun or rain will typically be too bulky to easily carry in a pocket, purse or handbag. Folding or rolling such hats will tend to wrinkle or otherwise deform them. Unfortunately, brims that can be easily folded or rolled must be soft and tend not to hold their shape.

Furthermore, another problem with collapsible hats is that they will typically look wrinkled after they have been collapsed then un-collapsed.

There have been many attempts in the prior art to solve some of the above problems.

U.S. Pat. No. 2,716,753, issued Sep. 6, 1955 to Gordon discloses a shape retaining collapsible cap which rolls or folds into a compact assembly, with the cap having a crown portion either reinforced around its perimeter or made of heavy hair cloth. Such a cap will still tend to cause an undue adverse affect on a wearer's hair style.

U.S. Pat. No. 2,803,015, issued Aug. 20, 1957 to Milone discloses an inflatable hat, which has a non-inflatable crown and an inflatable brim. Such a hat still tends to cause an undue adverse affect on a wearer's hair style, and since it requires deflating and inflating, is not readily collapsible to and from its compact form.

U.S. Pat. No. 3,097,363, issued Jul. 16, 1963 to Le Blanc discloses a plastic collapsible sun hat. The hat disclosed in this patent has a flexible frame which is formed of flexible air hoses or tubes which are inflated during use. The hat disclosed tends to cause an undue adverse affect on a wearer's hair style, and since it requires deflating and inflating, is not readily collapsible to and from its compact form.

U.S. Pat. No. 3,737,081, issued Jun. 5, 1973 to James discloses device for holding, storing and shaping western hats. Such patent does not disclose or suggest a hat which is easily collapsible or one that will not cause an undue adverse affect on a wearer's hair style.

U.S. Pat. No. 3,739,401, issued Jun. 19, 1973 to Fekete discloses a roll up hat which can be stored in a rolled up position. However, such a hat requires a snap fastener to retain it in a rolled up position, and still causes an undue adverse affect on a wearer's hair style.

U.S. Pat. No. 3,852,822, issued Dec. 10, 1974 to Watkins discloses a hard hat having a plurality of webbings about the internal periphery of the hard hat crown in order to form a suspension system operable to maintain the helmet in a spaced relationship from the wearer's head. Such a webbed hard hat is notoriously problematic to a wearer's hair style, resulting in a flattened or otherwise affected hair style. Further, this hard hat is not collapsible.

U.S. Pat. No. 3,869,727, issued Mar. 11, 1975 to Hartman discloses a foldable hat having sections, including a crown wall portion and a brim portion being hingedly connected to one another defining a hat which is to be collapsed into a folded condition in which sections are in a stacked relation. Such patent does not disclose or suggest a hat which will not affect a wearer's hair style.

U.S. Pat. No. 4,096,590, issued Jun. 27, 1978 to Keshock discloses a snap brim hat which has a crown, a brim assembly and tie straps. The brim assembly is manipulated between a pair of stable configurations. The patent does not suggest or disclose any structure for reducing wrinkling of the crown member.

U.S. Pat. No. 4,443,892, issued Apr. 24, 1984 to Burgin discloses a hat having a hat band and support structure intermediate said hat and hat band. The disclosed hat is not collapsible, and the band will tend to cause an undue adverse affect to the wearer's hair style by causing a ring like indention into hair extending circumferentially around the wearer's head.

U.S. Pat. No. 4,549,316, issued Oct. 19, 1985 to Johnson discloses a foldable hat having at least one preformed fold line along which a visor can be folded into a compact configuration. However, while in a compact configuration, the visor portion will extend from the configuration. Additionally, such a hat will still cause an undue adverse affect on a wearer's hair style.

U.S. Pat. No. 4,682,373, issued Jul. 28, 1987 to Baran discloses a collapsible hat wherein the body and brim of the hat are capable of being folded to generally curved planar condition. However, this hat requires a fastener to retain the hat in a folded condition, and will still cause an undue adverse affect on the wearer's hair style.

U.S. Pat. No. 4,815,784, issued Mar. 28, 1989 to Zheng is directed toward an automobile sunshield, but discloses in the background a cloth hat having a flexible circular member which can fold together to provide for storage. The patent does not disclose or suggest any structure for preventing an undue adverse affect on a wearer's hair.

U.S. Pat. No. 4,982,449, issued Jan. 8, 1991 to Finklestein discloses a cap brim or the like, comprising outer fabric layers joined to an intermediate backing by stitching. The backing comprises a middle layer of a foamed thermoplastic material, and outer layers of solid thermoplastic material bonded to both sides of the middle foam layer. The patent does not suggest or disclose any structure for reducing wrinkling of the crown member.

U.S. Pat. No. 4,999,851, issued Mar. 19, 1991 to Hall discloses a collapsible hat comprising a body and a frame, with the frame including a frame member and a connecting device. The patent does not disclose nor suggest any structure for preventing an undue adverse affect on a wearer's hair.

U.S. Pat. No. 5,188,097, issued Feb. 23, 1993 to Hansen discloses an apparatus for administering capillary massages to enhance the growth of hair. Such an apparatus is not a hat at all, and does not suggest or disclose any structure for preventing a wearer's hair from being "messed up". Further, this apparatus is not collapsible.

U.S. Pat. No. 5,247,709, issued Sep. 28, 1993 to Epply discloses a paper hat formed from kraft paper, having a rectangular top panel forming a crown with four planar side panels connected to the top panel. Such a hat comprises preformed fold lines along which the hat is easily folded for storage. Such a hat rests upon the wearer's head, making contact circumferentially around the wearer's head.

U.S. Pat. No. 5,287,561 issued Feb. 22, 1994 to Spector discloses a fabric hat which is easily convertible into a flying play object. The patent does not suggest or disclose any structure for preventing undue adverse affect to a wearer's hair.

U.S. Pat. No. 5,365,612, issued Nov. 22, 1994 to Yoshida discloses a disposable rain shield consisting of a bag having a looped shape and a peripheral inflatable bag. The patent does not suggest or disclose any structure for preventing an undue adverse affect to a wearer's hair.

U.S. Pat. No. Des. 352,596, issued Nov. 22, 1994 to Williams discloses an ornamental collapsible hat. The patent does not suggest or disclose any structure for preventing an undue adverse affect to a wearer's hair style.

None of the references above suggest or disclose any hat structure for preventing an undue adverse affect to a wearer's hair. Additionally, none of the above references disclose or suggest an easily collapsible hat having structure for preventing an undue adverse affect to a wearer's hair. Futhermore, none of the above references disclose or suggest a collapsible hat having structure for reducing wrinkling of the crown member after the hat has been un-collapsed.

Thus, there is a need in the art for a hat having structure for preventing an undue adverse affect to a wearer's hair.

There is another need in the art for an easily collapsible hat having structure for preventing an undue adverse affect to a wearer's hair.

There is even another need in the art for a hat having structure for shielding the wearer from the sun, rain and/or other elements, and also having structure for preventing an undue adverse affect to the wearer's hair.

There is still another need in the art for a hat that is easily collapsible into a compact nonbulky shape, and having structure for preventing an undue adverse affect to the wearer's hair.

There is yet another need in the art for a hat that is easily collapsible into a compact nonbulky shape, having structure for shielding the wearer from the sun, rain and/or other elements, and also having structure for preventing an undue adverse affect to the wearer's hair.

There is even still another need in the art for a hat that will allow air to circulate around the wearer's head to keep the head cool and yet protected from the elements.

There is even still another need in the art for a hat that is collapsible having a structure for reducing wrinkling after the hat is un-collapsed.

There is even yet another need in the art for a hat that is collapsible having a structure for reducing wrinkling after the hat is un-collapsed and also having a structure for preventing an undue adverse effect on a wearer's hair.

There is still even another need in the art for a hat that is collapsible having a structure for maintaining the shape of the crown after the hat is un-collapsed and also having a structure for preventing a wearer's hair from being "messed up".

There is still yet another need in the art for a hat that is collapsible having a structure to maintain the shape of the brim after the hat is un-collapsed and also having a structure for preventing an undue adverse effect on a wearer's hair.

These and other needs in the art will become apparent to those of skill in the art upon review of this specification, including its drawings and claims.

SUMMARY OF THE INVENTION

It is one object of the present invention to provide for a hat having structure for preventing an undue adverse affect on a wearer's hair.

It is another object of the present invention to provide for an easily collapsible hat having structure for preventing an undue adverse affect on a wearer's hair.

It is even another object of the present invention to provide for a hat having structure for shielding the wearer from the sun, rain and/or other elements, and also having structure for preventing an undue adverse affect on a wearer's hair.

It is still another object of the present invention to provide for a hat that is easily collapsible into a compact nonbulky shape, and having structure for preventing a wearer's hair from being "messed up".

It is yet another object of the present invention to provide for a hat that is easily collapsible into a compact nonbulky shape, having structure for shielding the wearer from the sun, rain and/or other elements, and also having structure for preventing a wearer's hair from being "messed up".

It is even still another object of the present invention to provide for a hat that is collapsible having a structure for reducing wrinkling after the hat is un-collapsed.

It is even yet another object of the present invention to provide for a hat that is collapsible having a structure for reducing wrinkling after the hat is un-collapsed and also having a structure for preventing an undue adverse effect on a wearer's hair.

It is still even another object of the present invention to provide for a hat that is collapsible having a structure for maintaining the shape of the crown after the hat is un-collapsed and also having a structure for preventing a wearer's hair from being "messed up".

It is still yet another object of the present invention to provide for a hat that is collapsible having a structure to maintain the shape of the brim after the hat is un-collapsed and also having a structure for preventing an undue adverse effect on a wearer's hair.

These and other objects of the present invention will become apparent to those of skill in the art upon review of this specification, including its drawings and claims.

According to one embodiment of the present invention there is provided a hat which will not cause an undesired affect on a wearer's hairstyle. The hat generally includes a multiplicity of elongated support members for supporting the hat on a wearer's head.

According to another embodiment of the present invention there is provided a hat which will not cause an undesired affect on a wearer's hairstyle. The hat generally includes a brim and a multiplicity of elongated support members for supporting the hat on a wearer's head.

According to even another embodiment of the present invention there is provided a hat which will not cause an undesired affect on a wearer's hairstyle. The hat generally includes framing built into the crown of the hat, a brim and a multiplicity of elongated support members for supporting the hat on a wearer's head.

According to still another embodiment of the present invention there is provided a hat having a crown member having an outer crown layer with a crown surface, and having an internal periphery for receiving at least a portion of a head of a wearer. The hat further includes a first half of an interengageable fastener affixed to the inner periphery. The hat also includes a multiplicity of elongated support members for supporting the hat on the head of a wearer, each support member having a first end comprising a second half of an interengageable fastener mated with the first half of the interengageable fastener and having a second end extending from the internal periphery. The hat finally includes a resilient member against which the outer crown layer is drawn such that the crown surface is wrinkle free.

According to yet another embodiment of the present invention there is provided a hat, which includes a crown member having an outer crown layer with a crown surface, and having an internal periphery for receiving at least a portion of a head of a wearer. The hat also includes a first half of an interengageable fastener affixed to the inner periphery. The hat further includes a multiplicity of elongated support members for supporting the hat on the head of a wearer, each support member having a first end comprising a second half of the interengageable fastener mated with the first half of the interengageable fastener and having a second end extending from the internal periphery. The even further includes a brim having an outer brim layer with a brim surface, and affixed to and extending circumferentially around the crown, with the brim comprising a casing having a framing. The hat finally includes a resilient member against which the outer crown layer or outer brim layer is drawn such that the crown surface or brim surface is wrinkle free.

According to even still another embodiment of the present invention there is provided a hat including a crown member having an outer crown layer with a crown surface, and having an internal periphery for receiving at least a portion of a head of a wearer, with the crown further comprising a casing having a framing. The hat also includes a multiplicity of elongated support members for supporting the hat on the head of the wearer, each support member having a first end supported by the internal periphery and having a second end extending from the internal periphery. The hat finally includes a resilient member against which the outer crown layer is drawn such that the crown surface is wrinkle free.

According to even yet another embodiment of the present invention there is provided a crown member having an outer crown layer with a crown surface, and having an internal periphery for receiving at least a portion of a head of a wearer. The hat also includes a first half of an interengageable fastener affixed to and covering substantially all of the inner periphery. The hat further includes a multiplicity of elongated support members for supporting the hat on the head of a wearer, each support member having a first end comprising a second half of an interengageable fastener mated with the first half of the interengageable fastener and having a second end extending from the internal periphery.

According to still even another embodiment of the present invention, there is provided a hat including a crown member having an outer crown layer with a crown surface, and having an internal periphery for receiving at least a portion of a head of a wearer. The hat also includes a first half of an interengageable fastener affixed to and covering substantially all of the inner periphery. The hat further includes a multiplicity of elongated support members for supporting the hat on the head of a wearer, each support member having a first end comprising a second half of the interengageable fastener mated with the first half of the interengageable fastener and having a second end extending from the internal periphery. Finally, the hat includes a brim having an outer brim layer with a brim surface, and affixed to and extending circumferentially around the crown, with the brim comprising a casing having a framing.

According to still yet another embodiment of the present invention, there is provided a hat including a crown member having an outer crown layer with a crown surface, and having an internal periphery for receiving at least a portion of a head of a wearer, with the crown further comprising a casing having a framing. The hat also includes a first half of an interengageable fastener affixed to and covering substantially all of the inner periphery. The hat further includes a multiplicity of elongated support members for supporting the hat on the head of the wearer, each support member having a first end comprising a second half of an interengageable fastener mated with the first half of the interengageable fastener and having a second end extending from the internal periphery.

According to even yet another embodiment of the present invention there is provided a collapsible hat with a resilient member for keeping the crown fabric and/or brim material smooth as the hat is collapsed and then un-collapsed.

DETAILED DESCRIPTION OF THE INVENTION

The hat of the present invention will be discussed first by reference to FIGS. 1–5. It should be understood that hat 10 of the present invention is not to be limited to the particular shape or style illustrated in the figures, but rather, hat 10 may comprise any desired shape that fashion, taste or trends dictate.

Figure 1:
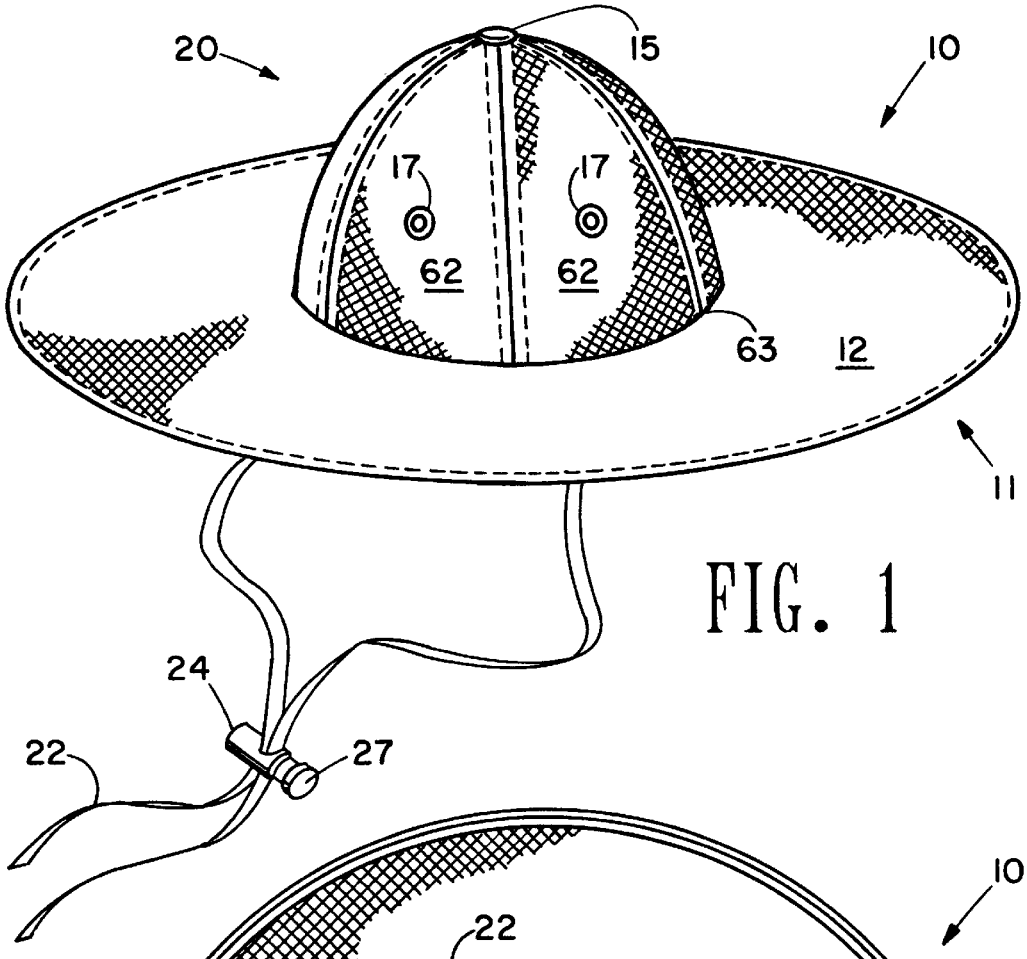
FIG. 1 is an illustration of one embodiment of the present invention showing hat 10 having brim 11 and crown portion 20.
Figure 2:
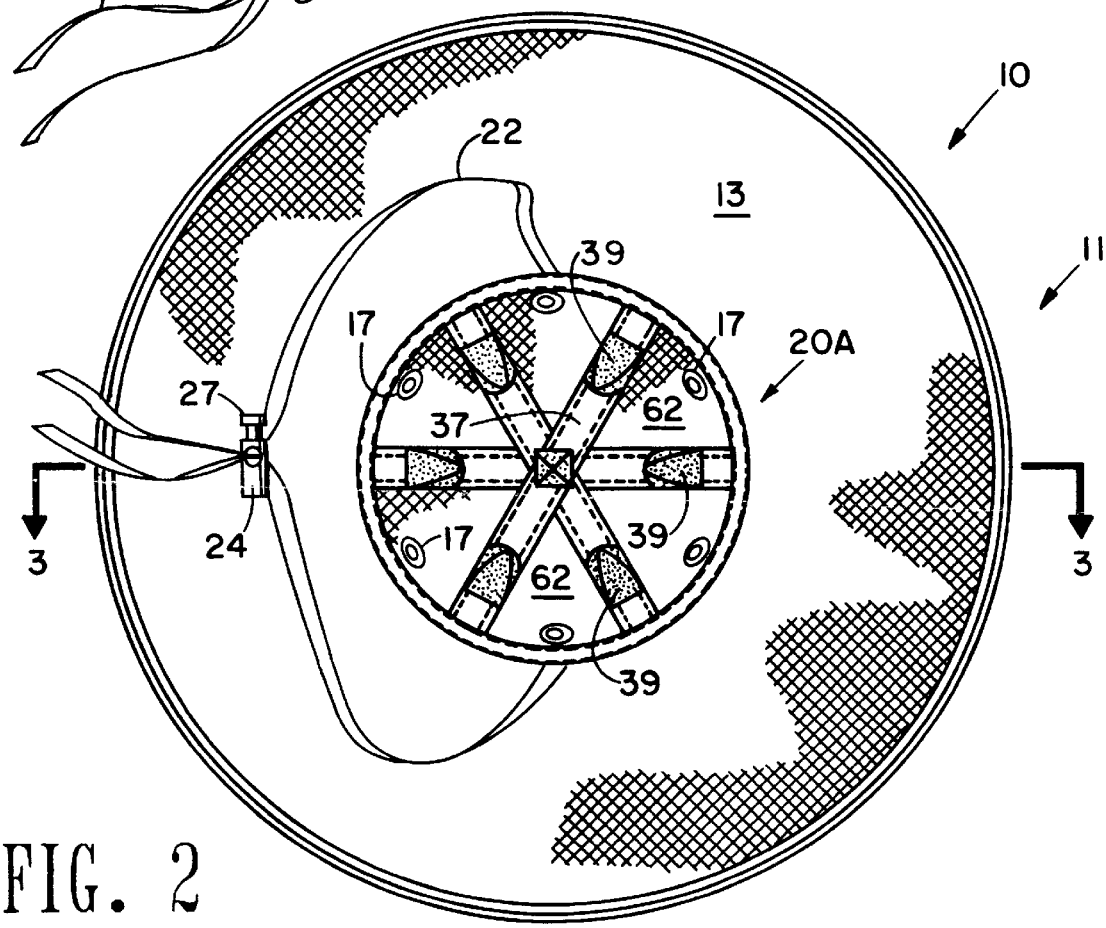
FIG. 2 is a view of the bottom of hat 10 of FIG. 1, showing inner portion 20A of crown portion 20, and brim 11.
Figure 3:
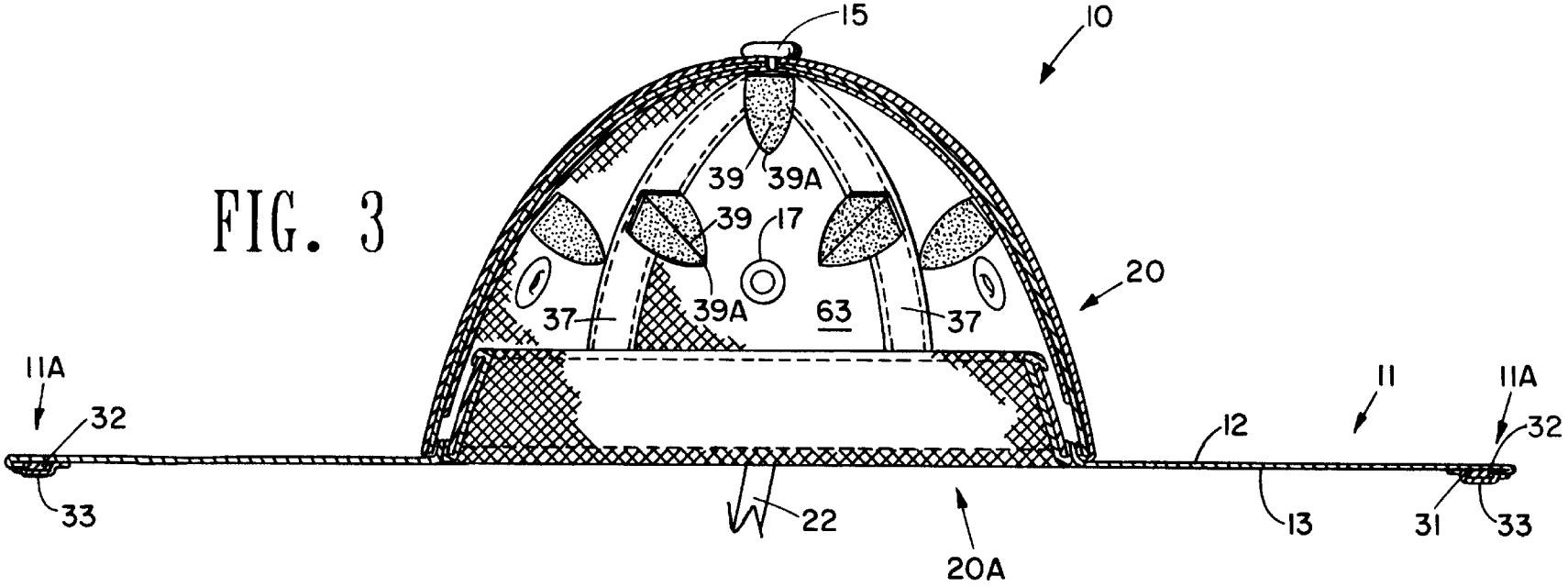
FIG. 3 is a cross-sectional view of hat 10 taken at line 3—3 of FIG. 2, showing hat 10 having brim 11 and crown portion 20.

FIG. 1 is an illustration of one embodiment of the present invention, showing hat 10 having brim 11, crown portion 20, and chin straps 22. FIG. 2 is a view of the bottom of hat 10 of FIG. 1, showing inner portion 20A of crown portion 20, and brim 11. FIG. 3 is a cross-sectional view of hat 10 taken at line 3—3 of FIG. 2, showing hat 10 having brim 11 and crown portion 20.

Crown portion 20 may be of any shape dictated by desire or fashion, and in the embodiment shown, includes a multiplicity of sections 62 which are joined together as shown in FIG. 1 by seams 63. Hat 10 further includes decorative button 15. Of course, sections 62 may be joined together by any suitable method, including by gluing, hot seaming, molding, melting, and any other method utilized in the fashion industry. While crown portion 20 is illustrated as having a six sections 62, it is to be understood that more or less numbers of sections could be utilized to provide the desired shape, including a unitary section.

Hat 10 of the present invention is not to be limited to any particular shape of sections 62, but rather, sections 62 may be any suitable shape that will provide a hat 10 of desired shape. A multiplicity of metal air vents 17 are placed around crown 20. While the present invention is not to be limited to the particular arrangement of or number of vents 17, in the embodiment shown in FIG. 1, 6 vents 17 are arranged circumferentially around crown 20.

Crown 20 includes an inner crown portion or inner periphery 20A, which is generally oversized relative to the wearer's normal or standard hatsize. Being oversized, hat 10 tends to minimize headaches from hat wear, and will not unduly restrain the wearer's head. Additionally, with inner crown portion 20A being oversized, contact of hat 10 with the wearer's face and head is minimized, thus reducing soilage of hat 10 from contact with the face and head.

A multiplicity of support members 39 extend from inner periphery 20*a*. These support members 39 serve to reduce the affect that crown portion 20 of hat 10 will have on the wearer's hair.

While any suitable shape of support member 39 may be utilized, support members 39 are preferably elongated. Any suitable cross-sectional shape may be utilized for support members 39. Non-limiting examples of suitable cross-sectional shapes include, circular, oval, oblong, triangular, square, star, as well as other n-sided regular and irregular geometric shapes.

Any number of support members 39 may be utilized, provided that the proper support and balance is provided, and provided that no undue adverse affect is caused to the wearer's hair style. Generally then, at least three support members 39 are utilized so that hat 10 may be easily balanced upon the wearer's head. Utilizing too many support members 39 will cause an undue adverse affect upon the wearer's hair style. In most instances, proper support and balance can be provided with from about 3 to about 25 support members 39. Preferably, from about 3 to about 12 support members 39 are utilized, and most preferably, from about 5 to about 10 support members 39 are utilized.

Support members 39 serve to reduce or eliminate the contacting of inner crown portion 20A with the wearer's hair to prevent inner crown portion 20A from causing any undue adverse affect to the wearer's hair style. With such a suspended arrangement, air may flow between the wearer's head and hat 10 providing a cooling effect. Thus, even one with little or no hair can benefit from this hat at it would provide a cooling affect to their head.

Much of the weight of hat 10 is supported upon ends 39A of support members 39. As the hair beneath ends 39A will be affected, it should be understood, that the larger the cross-sectional area of ends 39 of support members 39, the larger the affect upon the wearer's hairstyle, and the smaller the cross-sectional area of ends 39A of support members 39, the smaller the affect upon the wearer's hairstyle. Generally then, it is desirable to utilize smaller cross-sectional areas for ends 39*a*. Additionally, as support members 39 must traverse through the hair, the cross-sectional areas of support members 39 should likewise be of smaller cross-sectional areas.

While any suitable shape may be utilized, ends 39*a* of support members 39 are preferably rounded, pointed, or formed into a line or series of lines, to minimize the area of support member 39 which contacts the wearer's hair to prevent undue adverse affect to the wearer's hair style.

Support members 39 may be affixed directly to hat 10, or as in the embodiment shown in the figures, may be affixed to the hat utilizing a fastener 37. While any suitable shape of fasteners 37 may be utilized, fasteners 37 are generally elongated strips as illustrated.

Figure 10:
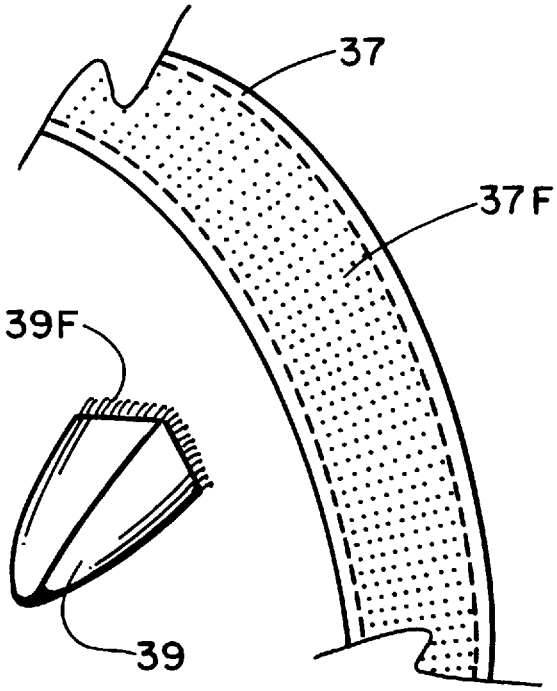
FIG. 10 illustrates that support members 39 are interengagable.
Figure 11:
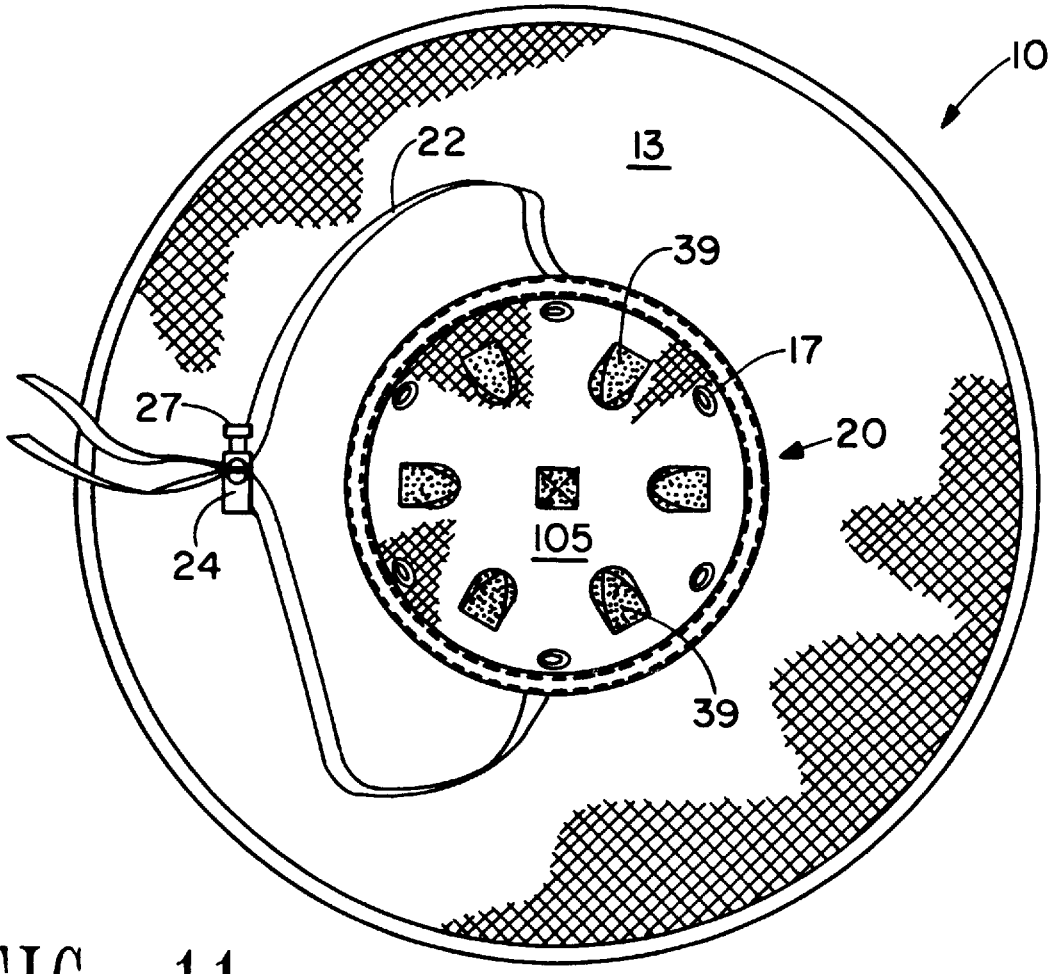
FIG. 11, illustrates crown lining 105, which replaces fastener strips 37, to which support members 39 may adhere.

Referring to FIG. 11, there is shown another embodiment of the present invention, in which support members 39 may be positioned throughout crown portion 20. As shown in this embodiment, support members 39 may be attached to a crown lining 105, which replaces fastener strips 37, and is made of a material suitable to interengagably fasten to support member 39. Crown lining may be made of the same material as is suitable for fastener strips 37. Crown lining 105 is designed to cover substantially all of inner portion 20A of crown portion 20. Generally, crown lining 105 will cover more area of inner portion 20A of crown portion 20 than the total of fastener strips 30. Preferably, crown lining 105 will cover more then 60% of the area of inner portion 20A of crown portion 20. More preferably, crown lining 105 will cover more than 80% of the area of inner portion 20A of crown portion 20. Even more preferably, crown lining 105 will cover more than 95% of the area of inner portion 20A of crown portion 20. Still more preferably, crown lining 105 will cover more than 98% of the area of inner portion 20A of crown portion 20.

Where a fastener is utilized, any suitable type of fastener system may be utilized to affix support members 39 to fasteners 37 or crown lining 105. For example matching snap fasteners may be utilized to affix support members 39 to fasteners 37 or crown lining 105. Preferably, fasteners 37 or crown lining 105 and support members 39 are affixed utilizing a hook and loop system, for example, a commercially available brand known as VELCRO. With such a hook and loop system, referring to FIG. 10, support members 39 are movably attached, and may be affixed anywhere along fastener strips 37 or on crown lining 105 as desired by the wearer.

Hat 10 optionally includes a brim 11, which provides protection against sun, rain and other elements. This brim 11 includes upper brim surface 12 and lower brim surface 13. At the outer circumference 11A of brim 11 is affixed an independent casing member 33, having an inner passage 31 in which frame 32 is positioned.

Figure 5:
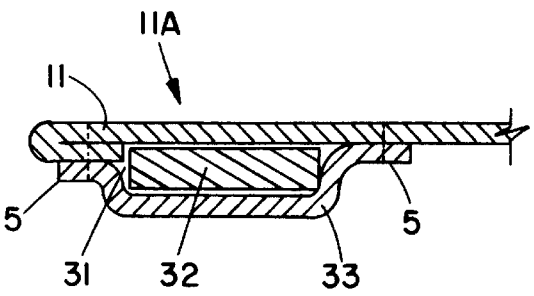
FIG. 5 is an enlarged view of end 11A of brim 11 of FIG. 3, showing casing 33, passage 31, framing 32, and thread 5.
Figure 4:
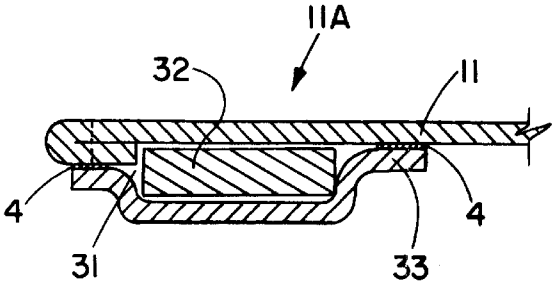
FIG. 4 is an enlarged view of end 11A of brim 11 of FIG. 3, showing casing 33, passage 31, framing 32, and glue 4.
Figure 6:
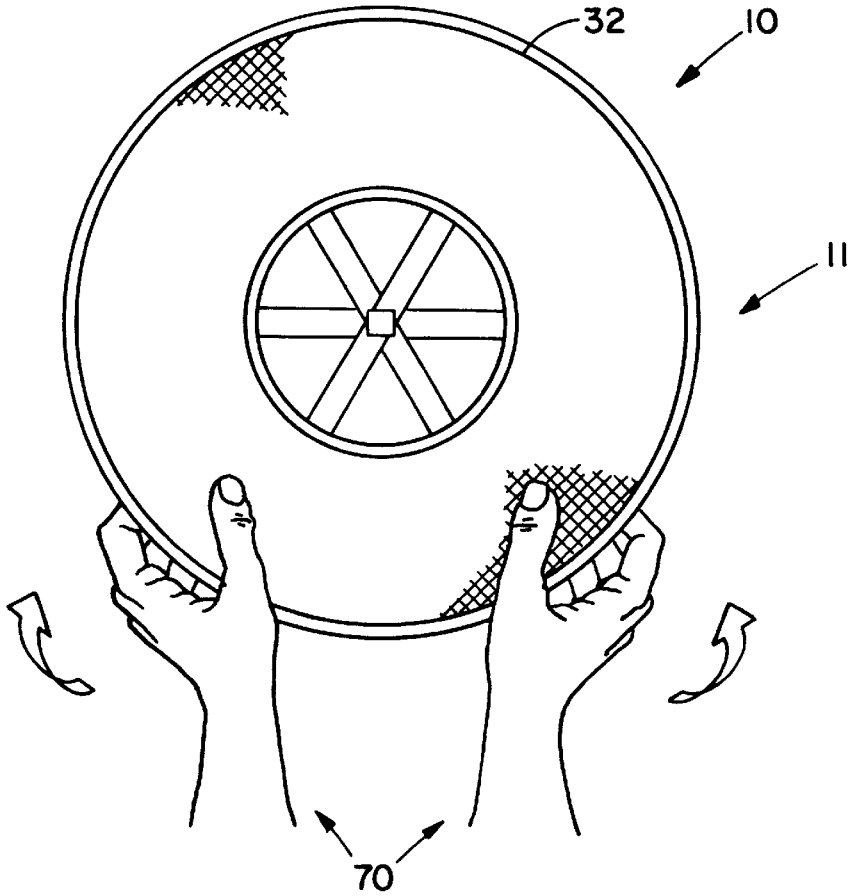
FIGS. 6–9, are illustrations which show the progression of hat 10 being collapsed by twisting brim 11 so that three loops are formed in frame 32.
Figure 7:
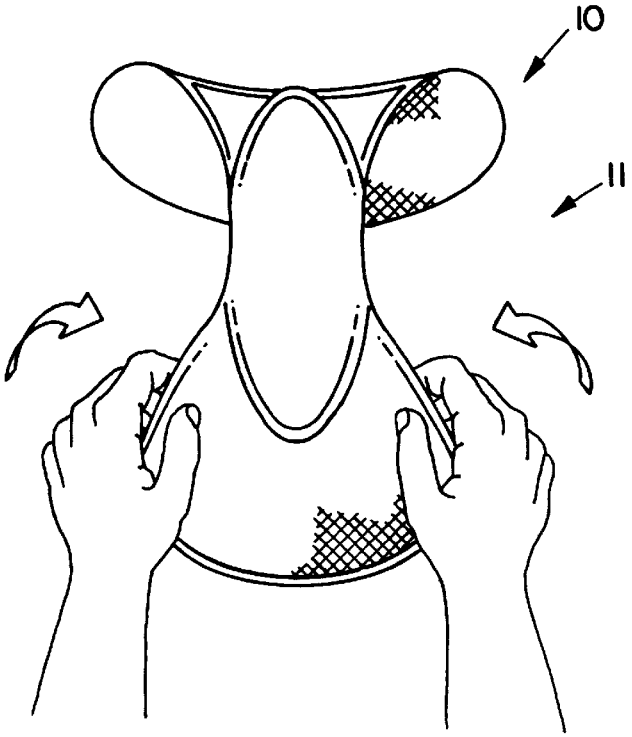
Figure 8:
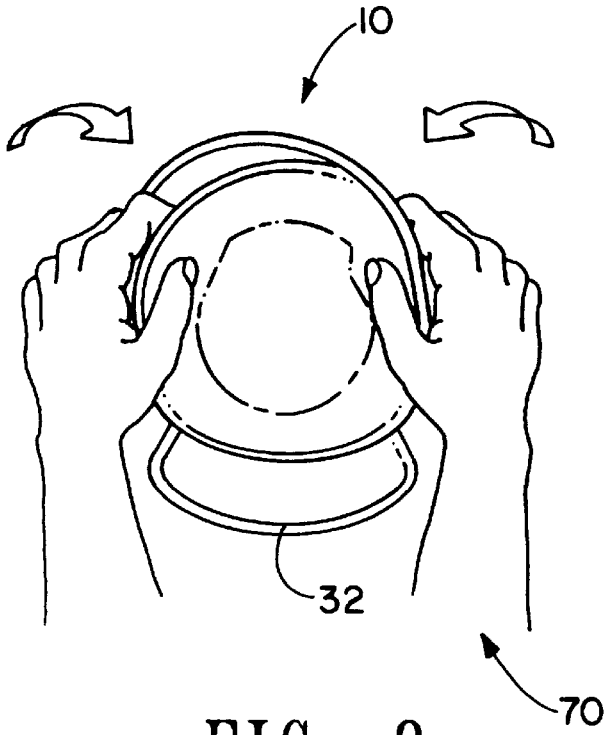
Figure 9:
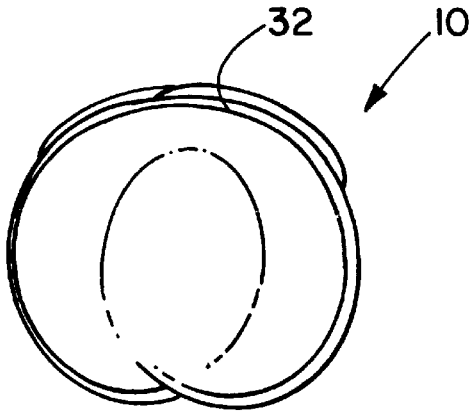

Referring now to FIG. 4 there is shown an enlarged view of end 11A of brim 11 of FIG. 3, showing casing 33, passage 31, framing 32, and glue 4, an to FIG. 5 there is shown an enlarged view of end 11A of brim 11 of FIG. 3, showing casing 33, passage 31, framing 32, and thread 5.

Independent casing member 33 may be affixed to brim 11 by any suitable method, including gluing or hot seaming with glue or hot seam material 4 as shown in FIG. 4, sewing with thread or cord 5 as shown in FIG. 5, and by other methods known in the fashion art.

While illustrated as extending around the entire circumference of hat 10, it is to be understood that brim 11 may also extend around only a portion of the circumference of hat 10, such as with a visor or bill, and may also comprise more than one brim portion.

Alternatively, at its outer circumference 11A, brim 11 may be folded over to form a casing 33 having inner passage 31. Of course, passage 31 could be formed by any suitable method, and may be any suitable shape.

A frame member which may be twisted to collapse the hat into a small compact size and shape, may be incorporated into hat 10 as taught and disclosed in U.S. Pat. No. 4,999,851, issued May 19, 1991 to Hall, herein incorporated by reference.

As will be understood, frame member 32 may be made of wire or plastic, or any other suitably bendable but "resilient" material, and may be any acceptable thickness. Examples of suitable frame members 32 include steel wire approximately 0.030" in diameter or ⅛" plastic tubing.

Figure 13:
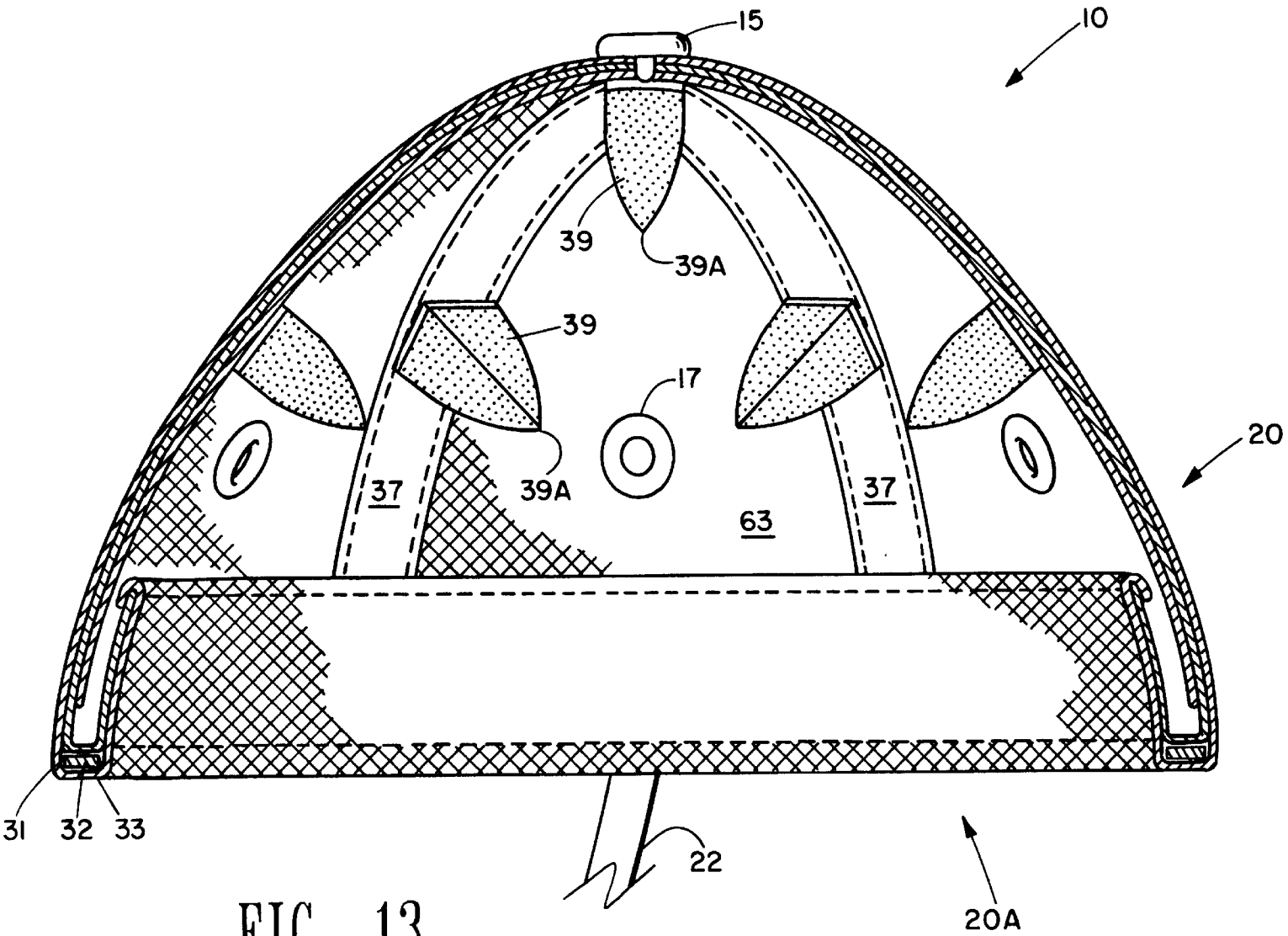
FIG. 13 is a cross sectional view of hat 10 taken at line 3—3 of FIG. 2 showing crown portion 20 having casing 33, passage 31 and framing 32.

The function of frame member 32 is better understood by reference to FIGS. 4–7, which show the progression of hat 10 being folded by a wearer's hands 70 twisting brim 11 so that three loops are formed in frame 32.

Where hat 10 does not include a brim member 11, frame 32 may be affixed directly to the crown portion of hat 10 as shown in FIG. 13.

Figure 12:
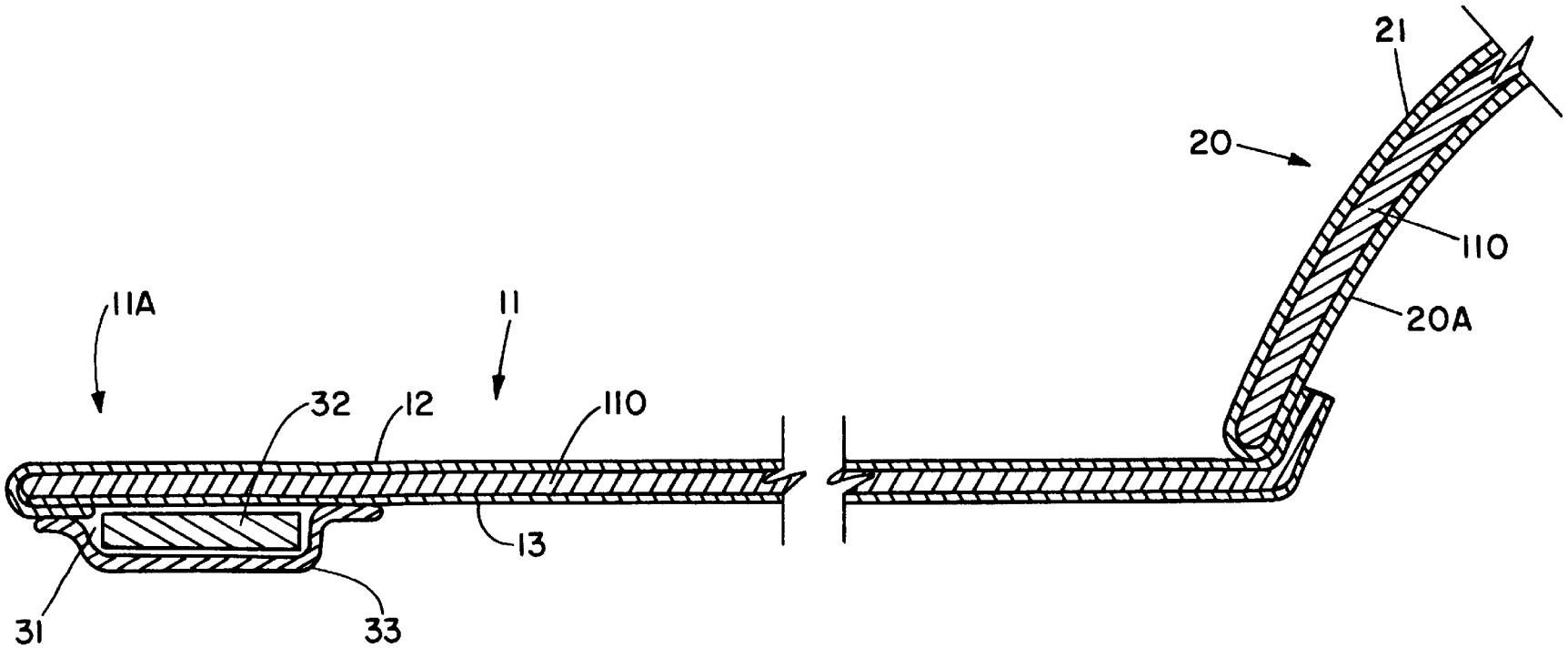
FIG. 12 is an enlarged view of FIG. 3 showing layer of material 110, preferably foam, which reduces wrinkling of hat caused while it was collapsed.

Referring to FIG. 12 a layer of resilient material 110 may be placed against outer fabric 21 of crown portion 20, and/or against upper surface fabric 12 of brim 11. Outer fabric 21 and upper surface fabric 12 will be drawn against resilient material 110 to produce an essentially wrinkle free surface when hat 10 is in a normal un-collapsed position.

Material 110 may also function as the outer layer, the inner lining or otherwise be attached to outer fabric 21 or upper surface fabric 12. It is understood that the layer of material 110, preferably foam, may be attached to the hat in any manner. Non-limiting examples of how material 110 may be attached include, use of an adhesive or stitching. The purpose of this layer is to reduce the ability of the outer fabric of the crown to become wrinkled when hat 10 is collapsed and then un-collapsed, to aid the brim in retaining it's shape when the hat is collapsed then un-collapsed, and to aid the hat in un-collapsing.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. A hat comprising:

(a) a crown member having an outer crown layer with a crown surface, and having an internal periphery for receiving at least a portion of a head of a wearer;

(b) a first half of an interengageable fastener affixed to the internal periphery;

(c) a multiplicity of elongated support members for supporting the hat on the head of a wearer, each support member having a first end comprising a second half of the interengageable fastener mated with the first half of the interengageable fastener and having a second end extending from the internal periphery; and, (d) a resilient member against which the outer crown layer is drawn such that the crown surface is wrinkle free.

2. The hat of claim 1 wherein the first half of the interengageable fastener covers substantially all of the internal periphery.

3. The hat of claim 1 wherein the interengageable fastener comprises a complementary hook and loop fastener system.

4. A hat comprising:

(a) a crown member having an outer crown layer with a crown surface, and having an internal periphery for receiving at least a portion of a head of a wearer;

(b) a first half of an interengageable fastener affixed to the internal periphery;

(c) a multiplicity of elongated support members for supporting the hat on the head of a wearer, each support member having a first end comprising a second half of the interengageable fastener mated with the first half of the interengageable fastener and having a second end extending from the internal periphery;

(d) a brim having an outer brim layer with a brim surface, and affixed to and extending circumferentially around the crown, with the brim comprising a casing having a framing; and, (e) a resilient member against which the outer crown layer or outer brim layer is drawn such that the crown surface or brim surface is wrinkle free.

5. The hat of claim 4 wherein the first half of the interengageable fastener covers substantially all of the internal periphery.

6. The hat of claim 4 wherein the interengageable fastener comprises a complementary hook and loop fastener system.

7. A hat comprising:

(a) a crown member having an outer crown layer with a crown surface, and having an internal periphery for receiving at least a portion of a head of a wearer, with the crown further comprising a casing having a framing;

(b) a first half of an interengagable fastener affixed to the internal periphery;

(c) a multiplicity of elongated support members for supporting the hat on the head of a wearer, each support member having a first end comprising a second half of the interengageable fastener mated with the first half of the interengageable fastener and having a second end extending from the internal periphery; and, (d) a resilient member against which the outer crown layer is drawn such that the crown surface is wrinkle free.

8. The hat of claim 7 wherein the first half of the interengageable fastener covers substantially all of the internal periphery.

9. The hat of claim 7 wherein the interengageable fastener comprises a complementary hook and loop fastener system.

10. A hat comprising:

(a) a crown member having an outer crown layer with a crown surface, and having an internal periphery for receiving at least a portion of a head of a wearer; and (b) a first half of an interengageable fastener affixed to and covering substantially all of the internal periphery;

(c) a multiplicity of elongated support members for supporting the hat on the head of a wearer, each support member having a first end comprising a second half of the interengageable fastener mated with the first half of the interengageable fastener and having a second end extending from the internal periphery.

11. The hat of claim 10 further comprising:

(d) a resilient member against which the outer crown layer is drawn such that the crown surface is wrinkle free.

12. The hat of claim 10 wherein the interengageable fastener comprises a complementary hook and loop fastener system.

13. A hat comprising:

(a) a crown member having an outer crown layer with a crown surface, and having an internal periphery for receiving at least a portion of a head of a wearer;

(b) a first half of an interengageable fastener affixed to and covering substantially all of the internal periphery;

(c) a multiplicity of elongated support members for supporting the hat on the head of a wearer, each support member having a first end comprising a second half of the interengageable fastener mated with the first half of the interengageable fastener and having a second end extending from the internal periphery;

(d) a brim having an outer brim layer with a brim surface, and affixed to and extending circumferentially around the crown, with the brim comprising a casing having a framing.

14. The hat of claim 13 further comprising:

(e) a resilient member against which the outer crown layer is drawn such that the crown surface is wrinkle free.

15. The hat of claim 13 wherein the interengageable fastener comprises a complementary hook and loop fastener system.

16. A hat comprising:

(a) a crown member having an outer crown layer with a crown surface, and having an internal periphery for receiving at least a portion of a head of a wearer, with the crown further comprising a casing having a framing;

(b) a first half of an interengageable fastener affixed to and covering substantially all of the internal periphery; and (c) a multiplicity of elongated support members for supporting the hat on the head of a wearer, each support member having a first end comprising a second half of the interengageable fastener mated with the first half of the interengageable fastener and having a second end extending from the internal periphery.

17. The hat of claim 16 further comprising:

(d) a resilient member against which the outer crown layer is drawn such that the crown surface is wrinkle free.

18. The hat of claim 17 wherein the interengageable fastener comprises a complementary hook and loop fastener system.

* * * * *